United States Patent [19]

Knight et al.

[11] 4,190,305

[45] Feb. 26, 1980

[54] STRUCTURAL SUPPORT FOR A REFRIGERATOR

[75] Inventors: J. Nelson Knight, Louisville, Ky.; Roger C. Turner, Milwaukee, Wis.

[73] Assignee: General Electric Company, Louisville, Ky.

[21] Appl. No.: 908,471

[22] Filed: May 22, 1978

Related U.S. Application Data

[62] Division of Ser. No. 749,087, Dec. 9, 1976, Pat. No. 4,107,833.

[51] Int. Cl.[2] ..... F25D 11/00; B65D 25/14; F16B 37/04

[52] U.S. Cl. ..... 312/214; 52/309.2; 52/309.7; 52/309.16; 220/444; 220/452; 312/236

[58] Field of Search ..... 312/214, 236; 62/DIG. 13; 220/444, 452, 453, 464, 467; 52/309.2, 309.4, 309.5, 309.7, 309.16

[56] References Cited

U.S. PATENT DOCUMENTS

| | | | |
|---|---|---|---|
| 2,728,702 | 12/1955 | Simon et al. | 52/309.2 |
| 2,924,860 | 2/1960 | Parmam, Jr. et al. | 20/35 |
| 3,378,972 | 4/1968 | Stanley | 52/309.2 |
| 3,512,323 | 5/1970 | Hupfer | 52/309 |
| 3,516,566 | 6/1970 | Franck | 220/9 |
| 3,546,064 | 12/1970 | Hamilton et al. | 161/185 |
| 3,622,215 | 11/1971 | Roberts | 312/214 |
| 3,632,011 | 1/1972 | Kitson | 220/14 |
| 3,632,012 | 1/1972 | Kitson | 220/14 |
| 3,815,657 | 6/1974 | Malek et al. | 160/229 |
| 3,818,664 | 6/1974 | Hillberg et al. | 52/309 |
| 3,895,146 | 7/1975 | Nishimaki et al. | 428/56 |
| 3,902,941 | 9/1975 | Witmers | 156/79 |
| 3,904,524 | 9/1975 | Pelton et al. | 52/309 |
| 3,913,996 | 10/1975 | Benford | 312/214 |
| 3,999,820 | 12/1976 | Haag | 312/214 |
| 4,082,825 | 4/1978 | Puterbaugh | 312/214 |

FOREIGN PATENT DOCUMENTS

| | | | |
|---|---|---|---|
| 772181 | 4/1957 | United Kingdom | 52/309.4 |

*Primary Examiner*—Alexander Grosz
*Attorney, Agent, or Firm*—Frederick P. Weidner; Radford M. Reams

[57] ABSTRACT

A refrigerator structural support is provided by permitting polyurethane foam reactant material to impregnate a body of fibrous material and to subsequently harden. The result is a third material having desirable stiffening and support characteristics. Various means are disclosed for controlling and advantageously using the result of the impregnation of fibrous material by foam reactant material.

5 Claims, 8 Drawing Figures

STRUCTURAL SUPPORT FOR A REFRIGERATOR

CROSS REFERENCE TO RELATED APPLICATION

This application is a Division of copending patent application Ser. No. 749,087 for "Structural Support for a Refrigerator," filed Dec. 9, 1976 in the names of J. Nelson Knight and Roger C. Turner, and assigned to the assignee of this application now issued as Letters Patent of the United States 4,107,833.

BACKGROUND OF THE INVENTION

1. Field of the Invention

The present invention relates generally to structural supports for use in refrigerator cabinets employing polyurethane foam insulation and, more particularly, to supports which may be used either generally as stiffening members or as parts of screw-anchoring systems for fastening loads to various panels of the refrigerator cabinets.

2. Description of the Prior Art

In the art of refrigerator cabinet construction, particularly where plastic inner liners are employed, it is frequently necessary to provide selective reinforcement. For example, particular panels in a refrigerator cabinet, which panels may be parts of either the liner or the outer case, may require stiffening. As another example, where shelf supports or the like are attached to the inner liner, particularly a plastic inner liner, some form of support is needed. A more screwreceiving aperture in the plastic is generally unsatisfactory, except where extremely light loads are involved, because insufficient area for thread engagement results and the entire load is concentrated on a very small portion of the plastic material. This can result in undesirable deformation or even cracking of th plastic sheet.

In a typical refrigerator construction, metallic plates are used generally as stiffening members where needed. In a more specific application, where a load is to be applied to a plastic inner liner, metallic or plastic back plates are employed. One typical specialized device for this last-mentioned purpose is known as a screw anchor and is generally formed of plastic. A screw member is applied to a suitable aperture in the liner, generally from the rear side thereof. The screw anchor includes a bore for receiving a screw and, additionally, a relatively large diameter, force distribution portion for contacting a significant area on the rear side of the plastic liner. This, of course, serves to distribute the load over a greater portion of the liner material. Additionally, when insitu foamed polyurethane insulation material is used within the refrigerator wall space, suitable projections on such a plastic screw anchor bond to the foam insulation material so that a portion of the applied load is transmitted to the foam.

Where exceptionally heavy loads must be applied to the inner liner, a separate metallic or molded plastic member may be employed which actually bridges between the inner liner and the outer case to transmit the applied interior load directly to the metal outer case.

There is another prior art construction which would appear to be unrelated to the present invention. However, in view of the nature of the invention, as will hereinafter become more apparent, this prior art construction is worthy of mention. In refrigerator constructions where insitu foamed polyurethane thermal insulation material is employed, during the foaming process, after injection of the foam reactant material but prior to solidification and hardening of the foam, large forces are developed which tend to force foam material through any available cracks or openings. Around the front face of a refrigerator cabinet there is generally an interface between a separate outer case and the inner liner. For example, the outer case may be made of steel and the inner liner of plastic. In order to prevent foam material from leaking through any crack which may be associated with this interface, a "foam stop" seal is typically employed. One foam stop which is typically employed is a suitably shaped, elongated body of glass fiber material applied around the periphery of and behind the front face. During the foaming process, when the polyurethane foam material contacts the foam stop, it penetrates and impregnates the glass fiber material approximately one-fourth inch. The foam material is thereby stopped and prevented from leaking through the crack. Upon solidification of the foam material, at the interface between the foam insulation and the glass fiber stop there is a region of rigid, dense material. This material occurs as a side effect to the foaming and sealing process, and other than being a part of the foam stop, it serves no particular purpose, although some rigidity may be added to the cabinet thereby.

In connection with glass fiber material, it is of course well known to employ such material to reinforce epoxy resin. This results in the hard structural material commonly known as "fiber glass," which is used to form the shells of any number of objects such as boats, automobiles, and storage tanks, where high strength is required. Such fiber glass material is to be distinguished from the material which results when polyurethane foam material impregnates glass fiber material. The latter, although relatively hard, is not nearly so hard as glass fiber reinforced epoxy resin, and it can be partially deformed, particularly by insertion of elongated objects with moderate forces and without the cracking of the body of material. It is also somewhat elastic. The properties of this material formed when polyurethanne foam material penetrates the glass fiber material are related to the properties of the polyurethane foam itself, in that a body of polyurethane foam is rigid, yet has elasticity and a slightly "spongy" feel such that it can be moderately deformed without breaking.

SUMMARY OF THE INVENTION

It is an object of the invention to provide a structural support for use in a refrigerator and which is compatible with polyurethane foam insulation.

It is another object of the invention to provide such a structural support using readily available materials.

These and other objects are accomplished by the present invention wherein a refrigerator structural support is provided generally by controlling and advantageously utilizing the phenomenon of the material formed by the penetration of polyurethane foam material into fibrous material, such as glass fiber material. Generally, a body of glass fiber material is positioned in a desired location and shaped in a form which permits thorough penetration of the polyurethane foam material so that the resulting material form a useful structural support.

In one embodiment, a body of fibrous material is attached to the wall space side of a panel of the refrigerator cabinet; for example, the inner liner. The attachment may be by adhesive or otherwise. Next, foam reactant material is injected into the wall space. As the foam reactant material expands into foam insulation, a portion of the foam reactant material impregnates the body of fibrous material and hardens to form a strong rigid support. For best results, the body of fibrous material is shaped in a form which allows thorough penetration of the foam reactant material. This may be accomplished, for example, by forming the body of fibrous material in a pad-like configuration which is no thicker than the expected penetration depth of the foam reactant material into the fibrous material. An alternative method of promoting thorough penetration of the foam material into the glass fiber material is to form suitable holes in the body of fibrous material prior to injecting the foam reactant material. The use of such holes permits the use of a thicker body of glass fiber material than otherwise would be possible, provided the holes are spaced sufficiently close together.

The present invention has uses other than merely backing up a panel member to add support and rigidity thereto. One example is use in conjunction with a plastic screw grommet to permit the attachment of parts such as shelf supports and the like to the inner liner of the refrigerator. As previously stated in the Background of the Invention, some means for distributing the applied load over a wider area of the panel is necessary, particularly where a plastic liner is employed. In accordance with the invention, a plastic screw anchor is embedded in the body of glass fiber material prior to the injection of the polyurethane foam material. After the foam material has penetrated the glass fiber body and hardened, the rigid body which results securely anchors and holds the screw anchor and, when a screw of the like is inserted in the screw anchor, the loading thereof is effectively transmitted to a wider portion of the inner liner. Additionally, a portion of the load is transmitted into the thermal insulation material itself. If desired, the screw anchor can be suitably shaped to serve as the attachment which anchors the body of glass fiber material in place prior to the foaming operation. After the foaming operation, the body of foam impregnated glass fiber material is securely anchored in place, since the foam material has adhesive properties in that it tends to adhere to both the plastic inner liner and the metal outer case.

Another use of the present invention is as a support which transmits a load applied to the inner liner to the outer case. For this application, a body of fibrous material which has a length sufficient for bridging between the inner liner and the outer case is provided. The body of fibrous material is attached within the wall space between the inner liner and the outer case. Lastly, foam reactant material is injected into the wall space. As the foam material expands into insitu foamed insulation, a portion penetrates and impregnates the body of foamed insulation, a portion penetrates and impregnates the body of fibrous material to form a rigid structural support bridging between the inner liner and the outer case. As in the previous embodiments, holes may be provided in the body of glass fiber material prior to the injection of the foam to promote through penetration of the foam material into the body of fibrous material. One method of anchoring such a support in place and, additionally, of conveniently providing a screw-receiving bore, is to provide a longitudinal aperture in the body of fibrous material and mating apertures in the inner liner and outer case. A suitable plastic fastener is inserted through the bore in alignment with the mating apertures. End fasteners hold the ends of the plastic fastener in place, thereby securing the entire assembly.

The present invention will be understood to contemplate not only the methods of forming the structural supports described herein, but, additionally, the resultant structural supports themselves.

BRIEF DESCRIPTION OF THE DRAWINGS

While the novel features of the invention are set forth with particularly in the appended claims, the invention, both as to organization and content, will be better understood and appreciated, along with other objects and features thereof, from the following detailed description taken in conjunction with the drawings in which:

DESCRIPTION OF THE PREFERRED EMBODIMENTS

Figure 1:
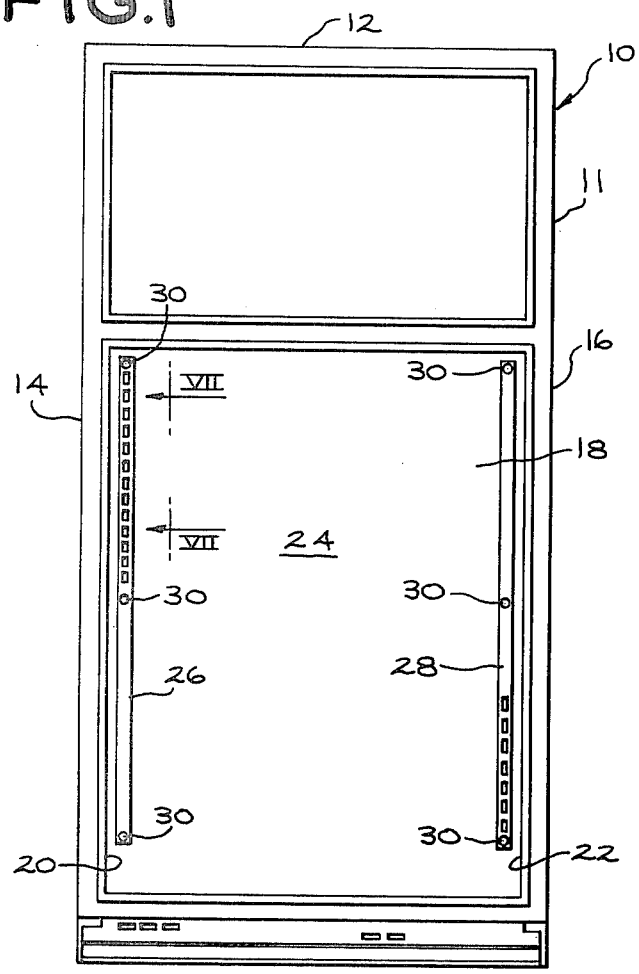
FIG. 1 is a front elevational view of an exemplary refrigerator in which the present invention is employed, the front doors being removed and a portion of a cantilever shelf track secured to the rear wall of the inner liner being visible.

Referring first to FIG. 1, there is generally illustrated a household refrigerator cabinet 10 to which the various structural supports of the present invention are applied. The refrigerator cabinet 10 comprises a stell outer case 11 including a top wall 12 and left and right side walls 14 and 16. Additionally, the refrigerator cabinet 10 comprises an exemplary plastic inner liner 18 which includes left and right side walls 20 and 22 and a rear wall 24. Lastly, the refrigerator cabinet 10 includes a pair of conventional cantilever shelf support tracks 26 and 28 secured by means of screws 30 generally to the inner liner wall 24.

Figure 2:
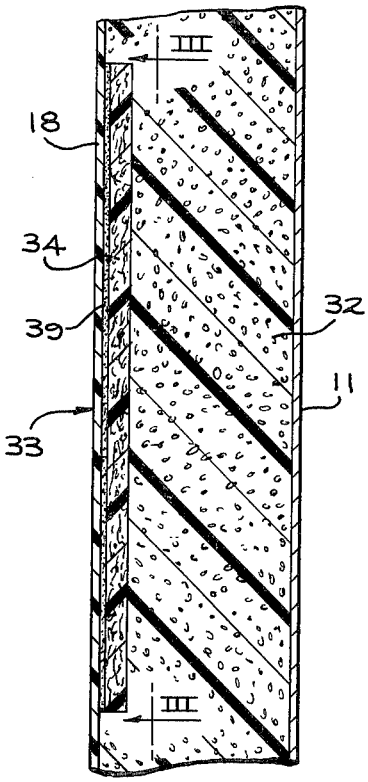
FIG. 2 is a cross-sectional view of a typical wall portion of the refrigerator of FIG. 1, showing a structural support according to the invention which lends strength and rigidity to a portion of the inner liner.

Referring now to FIG. 2, an exemplary cross section of one of the walls of the refrigerator cabinet 10 illustrates portions of the inner liner 18 and the outer case 11, with a solidified mass of insitu foamed polyurethane thermal insulation material 32 therebetween. As is well known in the art of refrigerator construction, such insulation material is foamed in placed by injecting foam reactant material in generally liquid form into the wall space between the inner and outer cases 18 and 11, whereupon the reactant material expands and eventually hardens into a cellular mass having suitable thermal insulation properties.

Within the wall space, there is additionally shown a first embodiment 33 of a structural support according to the present invention. Generally, the structural support 33 comprises a body 34 formed of fibrous material which is impregnated by foam reactant material and bonded to one of the refrigerator panels to lend support thereto. In the illustrated example the panel is shown as a portion of the inner liner 18. In a method of forming the structural support 33, a body of fibrous material is attached to the wall space side of the inner liner 18. Next, foam reactant material is injected in a conventional manner into the wall space. As the foam reactant material expands to produce the insitu foamed insulation, a portion of the foam reactant material impregnates the body of fibrous material and hardens to form the strong rigid support 33. The material produced by the penetration of the foam reactant material into the fibrous material and subsequent hardening is neither loose and flexible as is the fibrous material, nor is it light and cellular as is the insitu foamed insulation material 32. Rather, it is a difficult substance having useful properties as a rigid support, having good strength characteristics, yet not being excessively brittle. Additionally, it has better thermal insulation properties than a steel plate would.

One type of fibrous material which has been found particularly suitable and which is conveniently available is glass fiber material. However, other types of fibrous material, for example, nylon, rayon, or the like, may be employed as well. A particular grade of glass fiber material found to be suitable is one which is conventionally used for thermal insulation material, having a density of between approximately three and four pounds per cubic foot. If the glass fiber material used is too dense, on one hand, insufficient penetration of the foam reactant material results. On the other hand, if it is too loose, the body of glass fiber material is too yielding and as a result is simply pushed aside and compressed by the foam reactant material as it expands.

With the exemplary density range suggested above, a typical penetration depth of foam reactant material into the body of glass fiber material is one-quarter of an inch. For best results, the body of glass fiber material is shaped in a form which facilitates thorough penetration of the foam material. To this end, bearing in mind the approximate penetration depth of one-quarter inch, the body of fibrous material may simply be shaped in the form of a reltively flat pad as illustrated in FIG. 2, which, after impregnation and hardening, yields the structural support 33.

Figure 3:
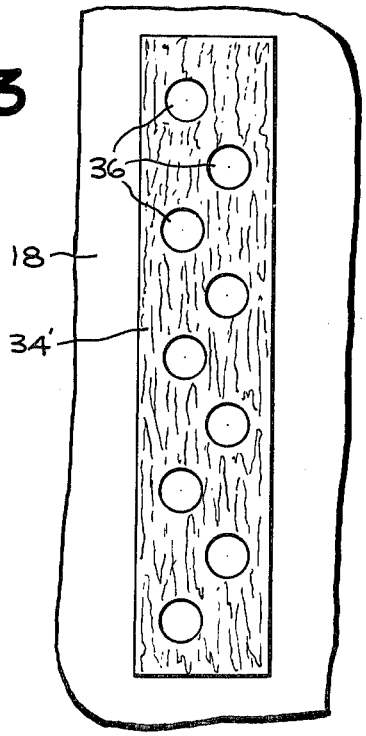
FIG. 3 is a view taken along line III—III of FIG. 2, prior to injection of the foam reactant material, illustrating a pattern of holes which may be employed to insure through penetration of foam reactant material into the body of fibrous material.

Referring now to FIG. 3, the view taken along III—III of FIG. 2 illustrates the body of glass fiber material prior to injection of the foam reactant material. To distinguish between the original body of glass fiber material and the structural support material which results after impregnation by the foam reactant material and hardening thereof, the body in its condition prior to impregnation by foam material is designated 34'. To further aid and promote penetration of the foam reactant material into substantially all portions of the body 34', a number of spaced holes 36 are formed in the body 34' prior to injecting foam reactant material. Particularly where a thicker body of glass fiber material is employed, such holes, as will be apparent, aid in conveying foam reactant material deeper into the body.

Figure 4:
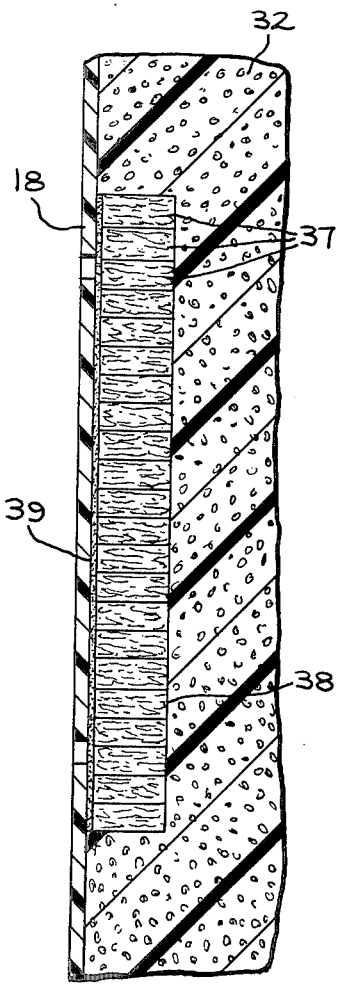
FIG. 4 is an enlarged, cross-sectional view similar to FIG. 2 but illustrating a "grain" orientation of the body of fibrous material which enhances penetration of foam reactant material.

Referring next to FIG. 4, there is illustrated another method for enhancing and promoting penetration of foam reactant material into a body of glass fiber material. Often, as a result of the process used to manufacture the glass fiber material, there is a predominate grain pattern wherein a majority of the individual fibers run generally in a single direction. Further, the glass fiber material may comprise a multiplicity of individual layers or batts having the same general grain. It has been found that the most thorough penetration of the foam reactant material into the body of glass fiber material occurs when the body of fibrous material is oriented for maximum exposure of the edge grain of the layers to the foam reactant material. This is depicted in FIG. 4 which shows a cross-sectional view of individual layers 37, which layers 37 are horizontal in the particular orientation illustrated. Prior to injection of foam reactant material, the body of fibrous material is oriented for maximum exposure of its edge grain, designated 38, to the foam material. As shown, the body is oriented with the fibers generally running across the narrower dimension of the body, with the direction of the fibers generally perpendicular to the edge grain surface 38.

In the method of forming structural support according to the present invention, various means of attaching the body of fibrous material to a panel are possible. In the embodiments of FIGS. 2 and 4, a layer 39 of suitable adhesive is employed to attach the body of fibrous material to the inner liner portion 18 prior to injection of the foam reactant material. As an alternative to the use of adhesive over the entire surface of the body of fibrous material, it may be attached in either a single or multiple spaced locations. Since the foamm material itself has adhesive properties, once the foam reactant material has penetrated the body of fibrous material to the point where it contacts the wall space side of the inner liner 18, it itself seves as the adhesive.

Figure 5:
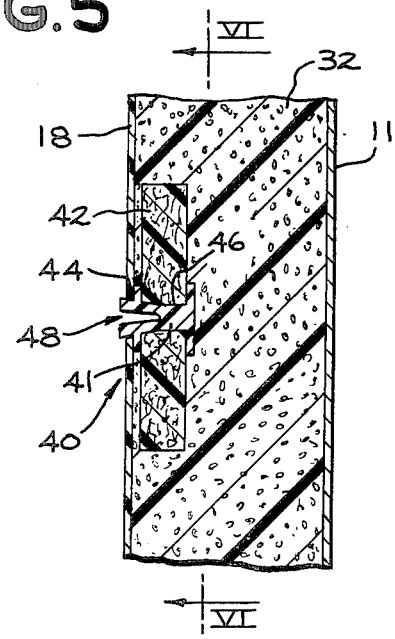
FIG. 5 is a cross-sectional view of another embodiment of the invention which includes an embedded screw anchor to distribute an applied load over a wider area of the plastic inner liner.

Referring now to FIG. 5, a structural support embodiment 40 includes a plastic screw anchor 41 embedded in a body 42 of impregnated fibrous material. In a method of constructing the support 40, mating apertures are provided in the panel 18 and in the fibrous body. Specifically, an aperture 44 is provided in the panel 18 and an aperture 46 is provided in the fibrous body. Next, the screw anchor 41 is inserted through the aperture 46, followed by further insertion through the panel aperture 44, whereby the screw anchor 41 and the body of fibrous material are secured in the desired position. The above procedure is most conveniently accomplished prior to installation of the inner liner 18 into the outer case 11, as unimpeded access to the rear of the liner 18 is then possible.

From the foregoing, it will be apparent that, prior to injection of the foam reactant material, the screw anchor 41 serves the additional function of holding the body of fibrous material in place, without the use of an adhesive. The method of constructing the support 40 next includes actually injecting the foam reactant material, some of which penetrates and impregnates the fibrous body and subsequently hardens to form impregnated fibrous body 42 which is illustrated. As previously described, the foam material itself serves as an adhesive to secure the body 42 to the panel 18. In use, the load applied by a screw or the like driven into the bore 48 of the anchor 41 is effectively transmitted through the impregnated body 42 to a wider portion of the inner liner 18 than would otherwise be the case. Additionally, a portion of the applied load is transmitted directly into the mass of solidified foam material 32.

Figure 6:
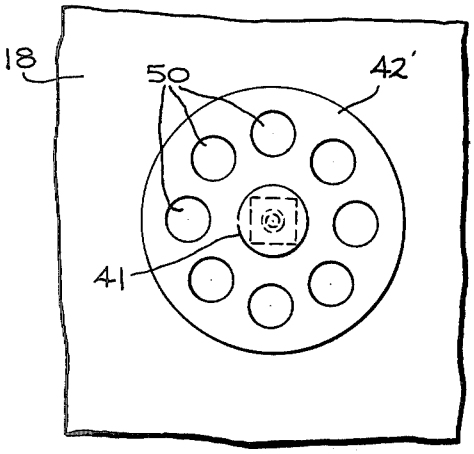
FIG. 6 is a view along line VI—VI of FIG. 5 and is similar to FIG. 3 in that it illustrates a pattern of holes which may be employed to insure better penetration of the foam reactant material into the body of glass fiber material.

Referring to FIG. 6, which is a section taken along line VII—VII of FIG. 5, but prior to the step of injection of the foam reactant material, there is shown generally the circular shape of the body of material 42' and, in addition, a number of holes 50, similar to the holes 36 (FIG. 3) which serve to promote penetration of foam reactant material into substantially all portions of the body 42' of fibrous material.

Figure 7:
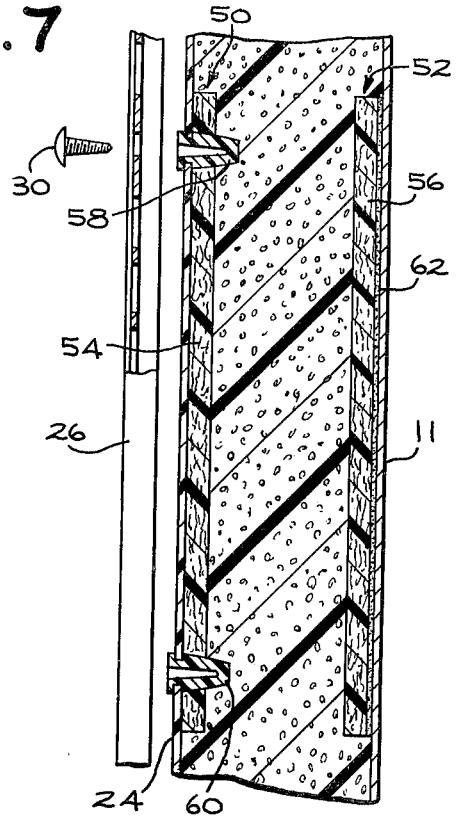
FIG. 7 is a partially exploded cross-sectional view taken generally along line VII—VII of FIG. 1 showing two structural supports, according to the invention, one having embedded screw anchors and serving to distribute the applied load of the cantilever shelf track, and the other being a structural support invention applied as a stiffener member along the outer case of the refrigerator cabinet.

Referring now to FIG. 7, two embodiments 50 and 52 of supports according to the present invention are shown. In FIG. 7, the supports 50 and 52 comprise pad-like bodies 54 and 56 which are attached to the rear portion 24 of the inner liner and the rear of the outer case 11, respectively. The first pad 54 is attached by means of screw anchors 58 and 60 in a manner similar to the attachment of the body 42 (FIG. 5). The second pad 56 is attached to the rear of the outer case 11 by means of a layer of adhesive 62. As will be apparent, the structural support 50 serves to receive the screws 30 which secure the cantilever shelf support 26 to the rear wall 24 of the inner liner 18. The loading of the cantilever track 26 is thus transmitted to a larger area of the plastic inner liner 18. Additionally, the support 52 serves to stiffen the outer case 11 in a region where it might otherwise be susceptible to bending, cooperating with the support 50 to form a rigid composite cross section.

Figure 8:
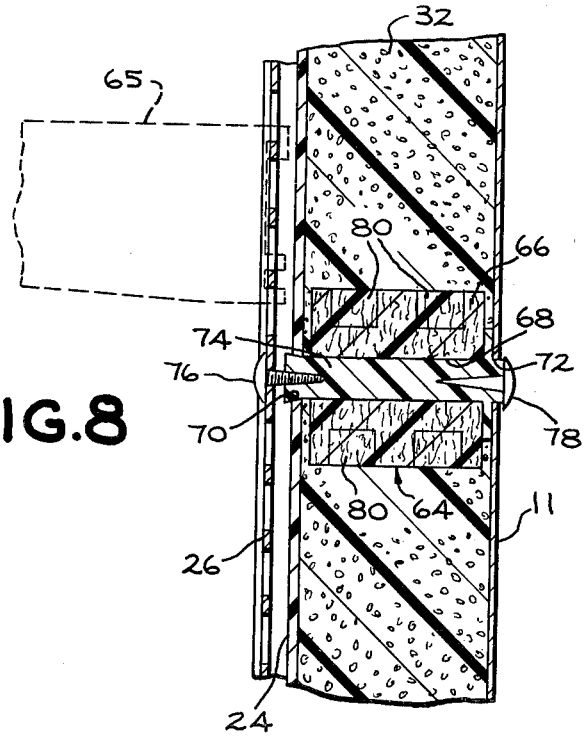
FIG. 8 shows an alternative embodiment of the invention in which a structural support transmits loading applied to the inner liner of the refrigerator cabinet to the sheel outer case.

Referring lastly to FIG. 8, there is illustrated a support 64 which may be used where it is desired to achieve greater load-carrying ability by transmitting a portion of the load applied to the rear 24 of the plastic inner liner 18 to the outer case 11. The specific load which is carried is the load imposed by the cantilever shelf track 26, including a shelf side frame member 65 (phantom lines) which engages the track 26. To form the support 64, a suitable body 66 of fibrous material is provided having a length sufficient for bridging between the inner liner 24 and the outer case 11. (Reference numeral 66 will be understood to actually designate the fibrous body in its later, impregnated state.) Next, the body of fibrous material is attached to the wall space sides of the inner liner and the outer case. In the illustrated embodiment, this is accomplished by providing a suitable longitudinal aperture 68 in the body of fibrous material and providing mating apertures 70 and 72 in the inner liner 24 and the outer case 11. Lastly, a plastic fastener 74 is inserted through the bore in alignment with the mating apertures. Suitable fasteners 76 and 78 are then employed at the ends of plastic fastener 74 to hold the entire assembly in position. As shown, the fastener 76 also serves to secure the track 26. Next, the foam reactant material is injected into the wall space which expands into the foam insulation material 32. As in the previously described embodiments, a portion of the foam reactant material impregnates the body of fibrous material to form the strong rigid support 64 bridging between the inner liner 24 and the outer case 11. Also, as in the previously described embodiments, the fibrous material may be glass fiber material or other fibrous material. The body is suitably shaped in a form which allows thorough penetration of the foam reactant material. As illustrated, this may be accomplished by forming radially extending holes 80 in the body of fibrous material prior to injection of the foam reactant material.

It will thus be apparent that the present invention provides methods for forming various useful structural supports in a refrigerator, as well as the supports themselves.

While specific embodiments of the present invention have been illustrated and described herein, it is realized that modifications and changes will occur to those skilled in the art. It is therefore to be understood that the appended claims are intended to cover all such modifications and changes as fall within the true spirit and scope of the invention.

What is claimed is:

1. In a refrigerator cabinet of the type employing insitu foamed polyurethane insulation within the wall space between the panel members forming the inner liner and the outer case, a strong, rigid, structural support which comprises:

a body formed by fibrous material with pre-formed holes in the body which facilitates thorough impregnation of the foam material and bonded to one of the panel members to lend support thereot, and a screw anchor embedded in the body of the impregnated fibrous material and extending through an aperature in the panel member.

2. In the construction of a refrigerator cabinet of the type having insitu foamed polyurethane thermal insulation material, a structural support which transmits a load applied to the inner liner to the outer case, comprising:

a body of fibrous material having a length sufficient to substantially bridge the inner liner and the outer case and attached to the wall space sides of the inner liner and the outer case; and foam reactant material filling the wall space with a portion of the foam reactant material pregnated in the body of fibrous material and solidified to form a strong, rigid support substantially bridging the inner liner and the outer case.

3. A structural support according to claim 2, wherein the fibrous material is glass fiber material.

4. A structural support according to claim 2, wherein the fibrous material is shaped with pre-formed holes in the body which facilitates thorough penetration of the foam reactant material into the body of the fibrous material.

5. A structural support according to claim 2, wherein attaching the body of fibrous material is accomplished by a longitudinal aperture in the body of fibrous material, a mating aperture in both the inner liner and outer case, and a fastener through the bore in alignment with the mating apertures.

* * * * *

UNITED STATES PATENT AND TRADEMARK OFFICE

CERTIFICATE OF CORRECTION

PATENT NO. : 4,190,305

DATED : February 26, 1980

INVENTOR(S) : Knight et al

It is certified that error appears in the above–identified patent and that said Letters Patent are hereby corrected as shown below:

Column 8, Line 32, the word "thereot" should be "thereto"

Column 8, Line 46, delete "pregnated in" and substitute therefor "thoroughly impregnating"

Signed and Sealed this

*Seventeenth* Day of *June 1980*

[SEAL]

*Attest:*

SIDNEY A. DIAMOND

*Attesting Officer*

*Commissioner of Patents and Trademarks*